United States Patent [19]

Hall

[11] Patent Number: 4,893,768

[45] Date of Patent: Jan. 16, 1990

[54] UTENSIL REST AND COMBINATION THEREOF WITH FOOD CONTAINER

[76] Inventor: Anson L. Hall, 22 Daggett Rd., Attleboro, Mass. 02703

[21] Appl. No.: 208,978

[22] Filed: Jun. 20, 1988

[51] Int. Cl.[4] ..... A47G 21/14

[52] U.S. Cl. ..... 248/37.3; 211/70.7; 220/23; 248/174

[58] Field of Search ..... 248/37.3, 37.6, 174, 248/176; 211/60.1, 69.1, 70.7; D6/512; 206/45.28, 23

[56] References Cited

U.S. PATENT DOCUMENTS

| | | | |
|---|---|---|---|
| 72,009 | 12/1867 | Foster | 248/37.3 |
| 333,082 | 12/1885 | Nichols | 248/37.3 |
| 2,292,413 | 8/1942 | Taylor | 220/23 X |
| 2,604,976 | 7/1952 | Sarg | 220/23 X |
| 3,103,224 | 9/1963 | Dearling | 220/23 X |
| 3,496,349 | 2/1970 | Townsend | 220/23 X |
| 3,514,029 | 5/1970 | Powell | 220/23 X |
| 3,624,787 | 11/1971 | Newman | 220/23 X |
| 3,679,093 | 7/1972 | Chang | 220/23 X |

*Primary Examiner*—J. Franklin Foss
*Attorney, Agent, or Firm*—Salter & Michaelson

[57] ABSTRACT

A utensil rest includes a bottom wall portion which is receivable on a supporting surface and an upstanding peripheral sidewall portion having a pair of spaced notches therein. The utensil rest is operative for receiving and supporting the blade end portion of a table knife in the notches and for supporting the eating end portion of another utensil on the upper edge of the sidewall portion. The utensil rest is adapted to be assembled on one end of a single-service food container so that it can be stored and transported with the food container and later disassembled therefrom for use as a utensil rest.

12 Claims, 3 Drawing Sheets

UTENSIL REST AND COMBINATION THEREOF WITH FOOD CONTAINER

BACKGROUND AND SUMMARY OF THE INVENTION

The instant invention relates to eating utensils and more particularly to a disposable utensil rest for supporting one or more utensils on a supporting surface and to a combination wherein the utensil rest detachably assembled with a food container.

Heretofore it has been common practice in restaurants, such as sandwich shops and fast-food restaurants, to place eating utensils and the like directly on the surfaces of counter tops or table tops, both prior to and between periods of use. However, it has been found that this practice can often be relatively unsanitary, since it not only can cause eating utensils to become contaminated with bacteria and/or various foreign substances, but it also can cause counter tops and table tops to be unnecessarily soiled. As a result, it has been found that the practice of placing eating utensils directly on counter tops and/or table tops prior to and between periods of use can be unsatisfactory to many restaurant patrons, as well as to many restaurant owners and/or operators.

The device disclosed in the applicant's copending U.S. patent application #07/143,171 generally addresses the need to provide an effective device for supporting a set of eating utensils on a counter top or the like both prior to and between periods of use. However, it has more recently been found that there is also a need for an effective utensil rest which is adapted to be shipped and stored in assembled relation with a food container and thereafter disassembled from the food container prior to use. Hence, the device of the subject invention has been developed to meet this previously unfulfilled need.

Heretofore available devices which represent the closest prior art to the subject invention of which the applicant is aware are disclosed in the U.S. Pat. Nos. to Dodge #227,224; Moore #799,612; Fresh #1,264,914; Pickering #2,354,968; Lunde #2,567,817; Gray #2,615,318; Mullins #2,651,927; Lee #2,789,349; and Brown #D-196,133. However, since the devices disclosed in these references are not adapted to be assembled with food containers in the manner of the utensil rest of the subject invention, they are believed to be of only general interest with respect thereto.

The instant invention provides an effective utensil rest which is adapted to be stored and transported in assembled relation with a conventional food container of the general type utilized for containing solid, semi-solid, or liquid foods, including beverages, and thereafter disassembled from the food container prior to use. More specifically, the utensil rest of the instant invention comprises a bottom wall portion which is adapted to be received on a supporting surface and an upstanding peripheral sidewall portion which extends upwardly from the bottom wall portion terminating in an upper edge. A pair of spaced, upwardly opening peripheral notches are formed in the sidewall portion for receiving and supporting the blade portion of a table knife, and the sidewall portion and the bottom wall portion are dimensioned for supporting the eating end portion of an additional table utensil on the upper edge of the sidewall portion. The utensil rest is adapted to be constructed in various configurations, including circular, square, or various other multi-sided configurations, and the sidewall portion preferably extends substantially continuously around the entire perimeter of the base portion. The utensil rest can be adapted to be assembled on either the top end or the bottom end of a food container so that it can be effectively stored and transported in assembled relation therewith and thereafter disassembled from the container prior to use as a utensil rest. In this regard, the utensil rest can be effectively adapted to be assembled with a container having a recessed bottom end so that the utensil rest is removably received in an inverted disposition in the bottom end. When the utensil rest is adapted to be assembled with a food container in this manner, it preferably further comprises a tab which extends outwardly from the edge of the peripheral sidewall portion for facilitating the disassembly of the utensil rest from the food container. Alternatively, the utensil rest can be adapted to be removably received in an inverted disposition on the upper end of a food container, such as a drinking cup. In this regard, the utensil rest of the instant invention can either be adapted to be assembled over the open upper end of a food container so that it functions as a cover therefor, or it can be assembled over a cover or top on a food container so that it provides hygienic protection for the top or cover, but in either case it can be effectively stored and transported in connection with a food container and thereafter disassembled from the container for use as a utensil rest. When the utensil rest is adapted to be assembled on a food container so that it functions as a cover therefor, the sidewall portion of the utensil rest preferably includes an engagement portion which extends upwardly from the base portion when the base portion is received on the supporting surface, the engagement portion being adapted to be received in engagement with the upper edge portion of the container member, and a rest portion which extends upwardly from the engagement portion to the upper edge. When the utensil rest is constructed in this manner, the slots preferably preferably extend into the rest portion of the sidewall but not into the engagement portion thereof.

It has been found that the utensil rest of the instant invention can be effectively transported and stored in combination with a food container and thereafter disassembled from the container prior to use as a utensil rest. In this regard, the utensil rest can be effectively adapted to be assembled on either the top end of a food container or on the bottom end thereof, depending on the particular type of container, and when the utensil rest is assembled over the top of a container, such as a soft-drink can, it provides hygienic protection for the top of the can. The utensil rest is adapted to be made in various disposable constructions from materials such as cardboard or plastic, although it can also be embodied in reusable "chinaware" constructions. In any event, the utensil rest is adapted to be effectively disassembled from a container and utilized for supporting one or more eating utensils both prior to and between periods of use. Alternatively, after the utensil rest has been disassembled from a container, it can also be effectively utilized as a coaster for a cup or a drinking glass.

Accordingly, it is a primary object of the instant invention to provide an effective utensil rest for supporting one or more eating utensils.

Another object of the instant invention is to provide an effective utensil rest which can be transported and stored in combination with a food container and thereafter disassembled from the container for use as a utensil rest.

An even further object of the instant invention is to provide a utensil rest comprising a bottom wall portion and an upstanding peripheral sidewall portion having a pair of spaced notches therein wherein the utensil rest is adapted for receiving the blade portion of a table knife in the notches and for supporting the eating end portion of an additional eating utensil on the upper edge of the sidewall portion.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
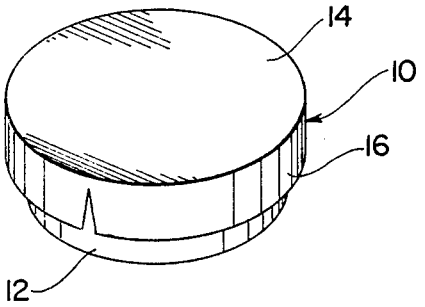
FIG. 1 is a perspective view of the utensil rest of the instant invention assembled on a food container.
Figure 2:
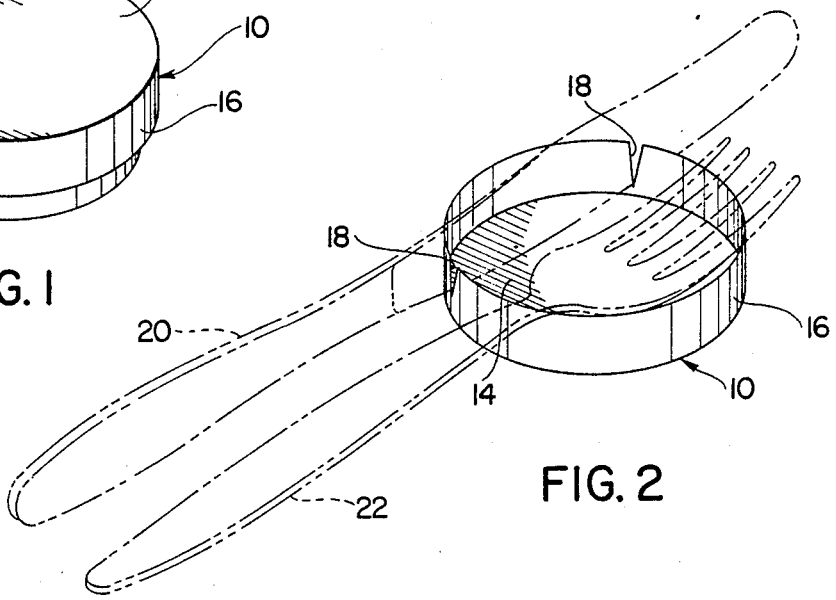
FIG. 2 is a perspective view thereof per se as it is utilized for supporting a pair of eating utensils.

Referring now to the drawings, a first embodiment of the utensil rest of the instant invention is illustrated in FIGS. 1 and 2 and generally indicated at 10. The utensil rest 10 is adapted to be assembled with a food container 12 as illustrated in FIG. 1 so that it can be stored and transported in combination with the food container 12, and it is adapted to be thereafter disassembled from the food container 12 for use in the manner a utensil rest in the manner illustrated in FIG. 2. The food container 12 comprises a conventional single-service food container which is adapted for containing a single serving of a food or condiment, such as cream, jelly, or ketchup. The container 12 can be alternatively embodied so that it includes a separate cover portion (not shown), or it can be assembled with the utensil rest 10 so that the utensil rest 10 is received and detachably secured on the upper end of the container 12 to function as a cover therefor. The utensil rest 10 is preferably made of a suitable plastic or cardboard, and it comprises a bottom wall portion 14 which is adapted to be received on a supporting surface in the manner illustrated in FIG. 2 and an upstanding sidewall portion 16. The sidewall portion 16 extends upwardly and substantially continuously around the perimeter of the bottom wall portion 14 and a pair of upwardly opening spaced notches 18 are formed therein. As illustrated in FIG. 2, the utensil rest 10 is adapted for supporting the blade of a table knife 20 and the eating end portion of a table fork 22 on a supporting surface. Specifically, the blade is receivable in the slots 18 for maintaining blade of the table knife 20 in a substantially "on-edge" disposition and in upwardly spaced relation to a supporting surface. The utensil rest 10 is adapted for supporting the eating end portion of the fork 22 on the upper edge of the sidewall portion 16 in order to maintain the eating end portion of the fork 22 in upwardly spaced relation to a supporting surface as illustrated. Alternatively, the utensil rest 10 can be effectively utilized for supporting other eating utensils, such as tablespoons, soup spoons, or teaspoons in a similar manner.

Figure 3:
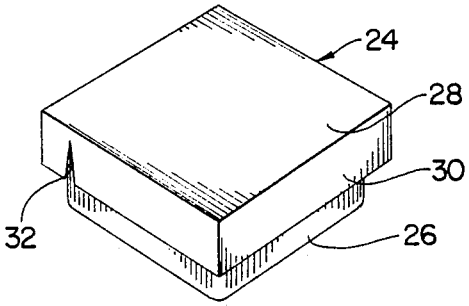
FIG. 3 is perspective view of a second embodiment of the utensil rest assembled on a container.
Figure 4:
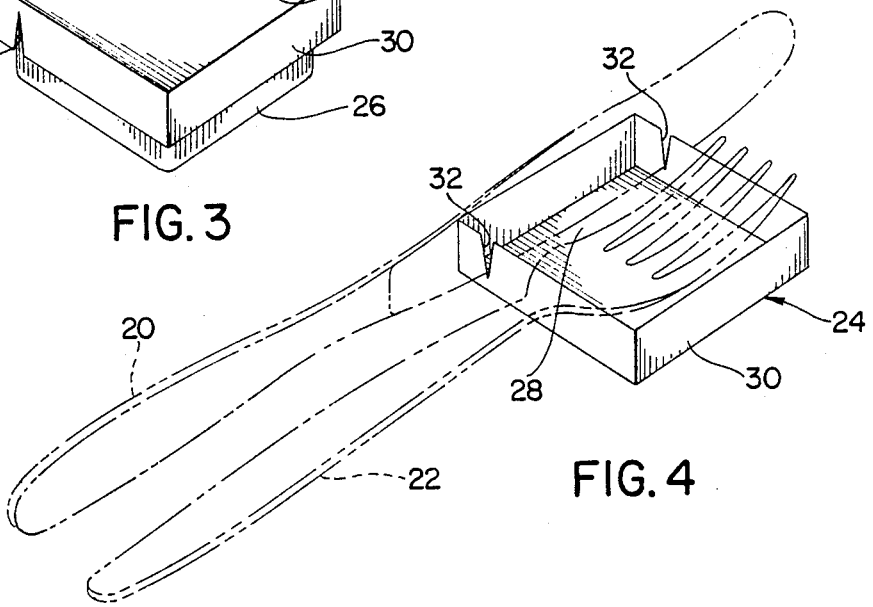
FIG. 4 is a perspective view thereof per se as utilized for supporting a pair of eating utensils.

A second embodiment of the utensil rest of the instant invention is illustrated in FIGS. 3 and 4 and generally indicated at 24. As illustrated in FIG. 3, the utensil rest 24 is adapted to be stored and transported in combination with a food container 26 and thereafter removed from the container 26 for use as a utensil rest in the manner illustrated in FIG. 4. The container 26 comprises a conventional, substantially square single-service food package which is preferably molded from a suitable plastic material and adapted for storing and transporting various foods, such as butter or jelly. The container 26 can either be adapted to include a conventional removable cover (not shown) for covering the upper end thereof, or it can be adapted to be assembled with the utensil rest 24 so that the utensil rest 24 forms a cover for the upper end thereof. In either case, the utensil rest 24 is adapted to be assembled and detachably secured in an inverted disposition on the upper end of the container 26 and thereafter removed so that it can be utilized for supporting a pair of utensils, such as the knife and fork 20 and 22, respectively. The utensil rest 24 is also preferably made of a plastic or cardboard material, and it comprises a bottom wall portion 28 of generally square configuration which is adapted to be received on a supporting surface and a peripheral sidewall portion 30 which extends upwardly and substantially continuously around the perimeter of the bottom wall portion 28. The sidewall portion 30 has a pair of spaced slots 32 therein which are disposed in substantially aligned relation on opposite side portions of the sidewall portion 30 as illustrated. The container 24 is dimensioned for receiving and supporting the blade portion of the knife 20 in the slots 32 and for receiving and supporting the eating end portion of the fork 22 on the upper edges of the wall portion 30 in the manner illustrated in FIG. 4.

Figure 5:
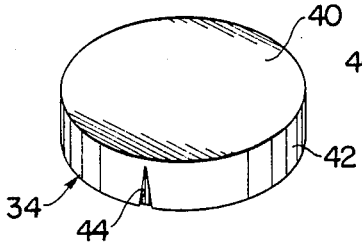
FIG. 5 is a perspective view of a third embodiment of the utensil rest assembled on a container.
Figure 6:
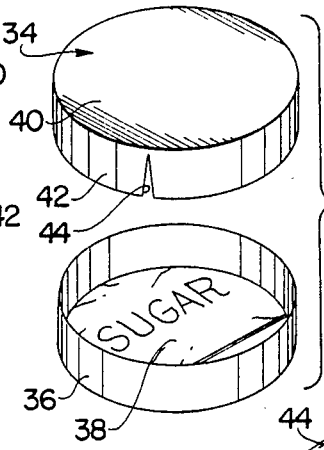
FIG. 6 is an exploded perspective view thereof.
Figure 7:
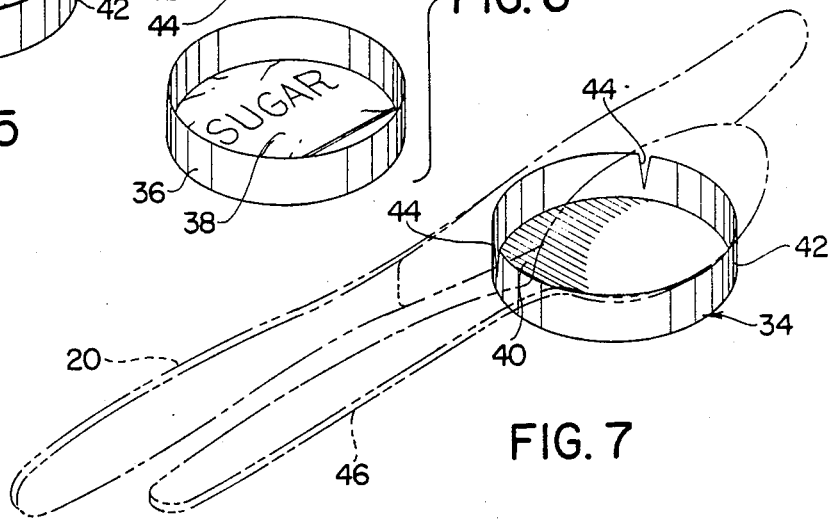
FIG. 7 is a perspective view thereof per se as utilized for supporting a pair of eating utensils.

A third embodiment of the utensil rest of the instant invention is illustrated in FIGS. 5 through 7 and generally indicated at 34. As illustrated in FIG. 6, the utensil rest 34 is adapted to be assembled with a container 36 so that it cooperates therewith to define an enclosed package for containing a prepackaged food item, such as a sugar packet 38. The container 36 is preferably made from a suitable material, such as a cardboard or plastic, in a substantially circular configuration, and the utensil rest 34 is also of substantially circular configuration, although it is of slightly greater diameter than the container 36 so that it can be received and detachably secured in assembled relation thereon. The utensil rest 34 is preferably made from a suitable cardboard or plastic material, and it comprises a bottom wall portion 40 of substantially circular configuration and a sidewall portion 42 which extends upwardly from the bottom wall portion 40 and substantially continuously around the perimeter thereof. Formed in the sidewall portion 42 is a pair of spaced slots 44 which open upwardly when the bottom wall portion 40 is received on supporting surface. As illustrated in FIG. 7, the utensil rest 34 is operative for supporting a pair of utensils, such as the knife 20 and a spoon 46, so that the blade of the knife 20 is received in the slots 44 and spaced upwardly from the supporting surface and so that the eating end portion of the spoon 46 is supported on the upper edge of the sidewall portion 42 and therefore maintained in upwardly spaced relation to the supporting surface.

Figure 8:
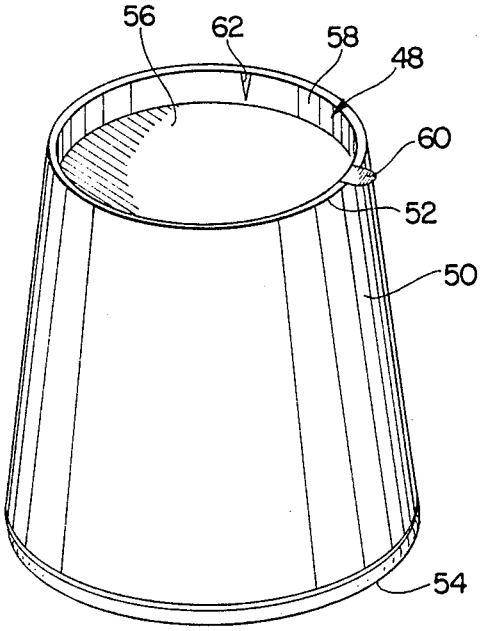
FIG. 8 is a perspective view of a fourth embodiment of the utensil rest assembled on a food container.
Figure 9:
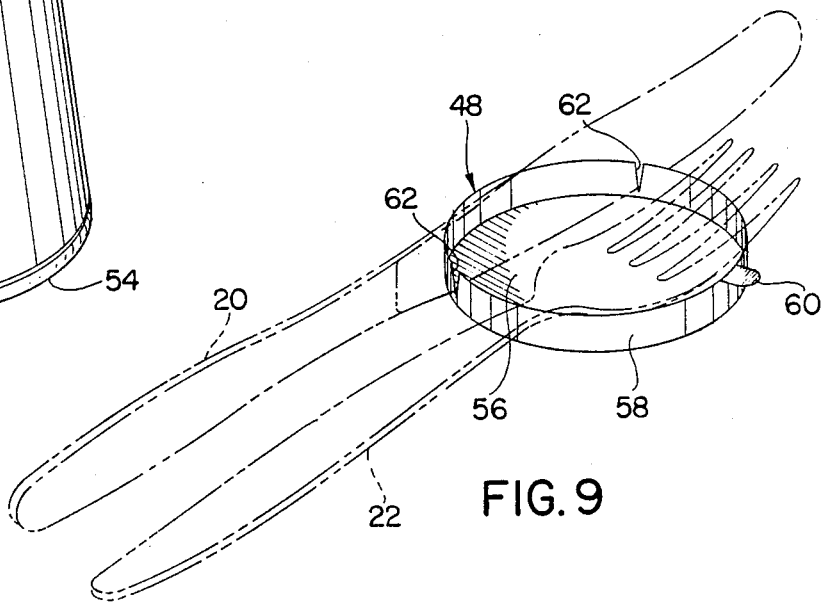
FIG. 9 is a perspective view thereof per se as utilized for supporting a pair of eating utensils.

A fourth embodiment of the utensil rest of the subject invention is illustrated in FIGS. 8 and 9 and generally indicated at 48, the utensil rest 48 being adapted to be assembled on the bottom end of a container 50 in the manner illustrated in FIG. 8. The container 50 preferably comprises a conventional drinking cup, and it is preferably constructed from a suitable paper, cardboard or plastic material. As illustrated in FIG. 8, the container 50 includes a recessed bottom end 52 and an open top end 54. The utensil support 48 is adapted to be received and detachably secured in an inverted disposition in the recessed bottom end 52 of the container 50 in the manner illustrated in FIG. 8, so that it can be effectively transported and stored in combination with the container 50 and thereafter removed from the container 50 for use as a utensil rest in the manner illustrated in FIG. 9. The utensil rest 48 is also preferably made from a suitable cardboard or plastic material, and it comprises a substantially circular bottom wall portion 56 which is adapted to be received on a supporting surface and an upstanding peripheral sidewall portion 58 which extends upwardly and substantially continuously around the perimeter of the bottom wall portion 56. The utensil rest 48 further comprises a tab 60 which extends outwardly from the upper edge of the sidewall portion 58, and a pair of spaced notches 62 are formed in the sidewall portion 58 so that they open upwardly when the utensil rest 48 is received on a supporting surface. The utensil rest 48 is adapted to be utilized for supporting a table knife 20 and a fork 22 in the manner illustrated in FIG. 9 so that the blade portion of the knife 20 is received in the slots 62, and the eating end portion of the fork 22 is received on the upper edge of the sidewall portion 58.

Figure 10:
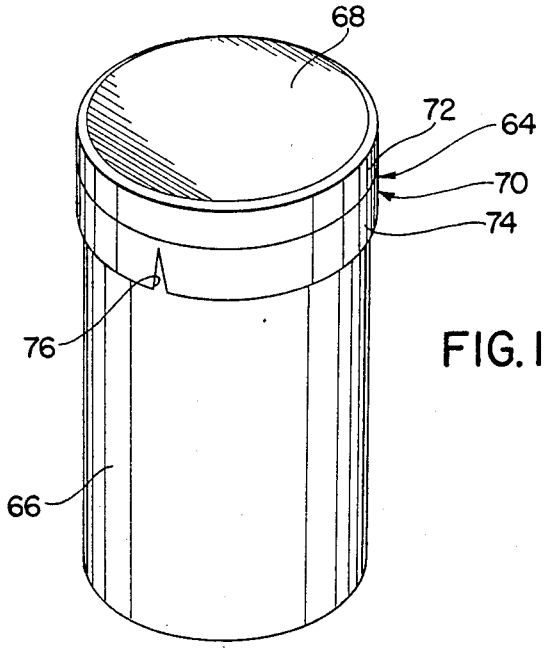
FIG. 10 is a perspective view of a fifth embodiment of the utensil rest assembled on a food container.
Figure 11:
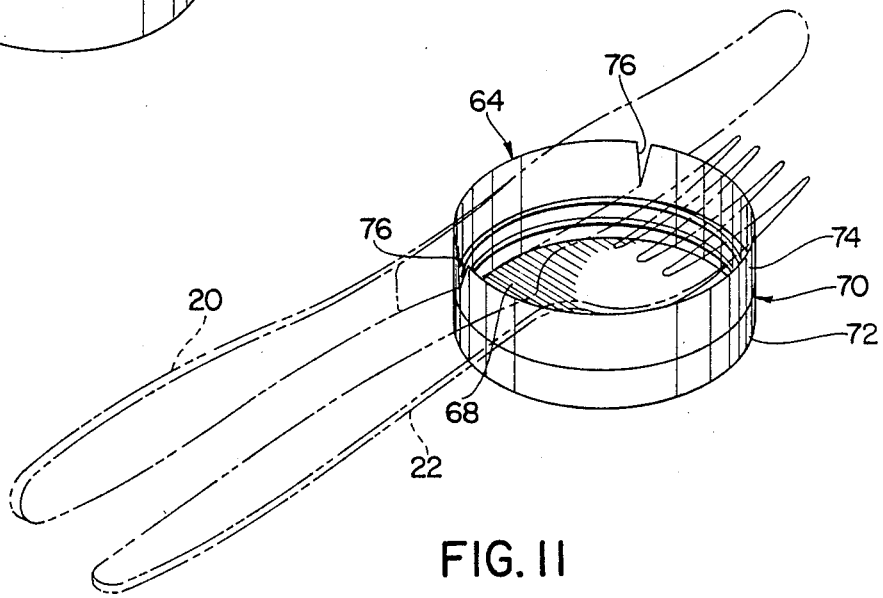
FIG. 11 is a perspective view thereof per se as utilized for supporting a pair of eating utensils.

Referring now to FIGS. 10 and 11, a fifth embodiment of the utensil rest of the subject invention is illustrated and generally indicated at 64. The utensil rest 64 is adapted to be stored and transported in combination with a food container 66 and thereafter removed from the container 66 for use as a utensil rest in the manner illustrated in FIG. 11. The container 66 comprises a conventional jar of the type which is adapted to contain a solid, semi-solid or liquid food, such as a beverage, and it is adapted to receive a threaded cover on the upper end thereof and is preferably made of a suitable material, such as metal, glass or plastic. It will be understood that alternatively the container 66 could be adapted to snap-receive a utensil rest thereon, in which case the utensil rest would function as a hygienic dust cover. The utensil rest 64 is preferably made of a suitable plastic, and it is adapted to be threadedly received on the container 66 so that it provides a cover for the open upper end thereof. The utensil rest 64 comprises a substantially flat bottom wall portion 68 and an upstanding sidewall portion generally indicated at 70. The bottom wall portion 68 is adapted to be received on a supporting surface, and the sidewall portion 70 extends upwardly from the bottom wall portion 68 and substantially continuously around the perimeter thereof. The sidewall portion 70 comprises a threaded engagement portion 72 which is integrally joined to the bottom wall portion 68 and adapted to be threadedly received on the upper end of the container 66 and a utensil rest portion 74 which is integrally joined to the engagement portion 72. A pair of spaced, upwardly opening slots 76 are formed in the utensil rest portion 74 for receiving and supporting the blade end portion of a table knife 20, and the utensil rest 64 is also adapted for receiving and supporting the eating end portion of an additional eating utensil, such as a fork 22, on the upper edge of the utensil rest portion 74.

It is seen, therefore, that the utensil rests of the instant invention are not only highly practical but also highly effective for supporting eating utensils on supporting surfaces both prior to and between periods of use. The utensil rests 10, 24, 34, 48 and 64 can be effectively transported and stored with their respective containers 12, 26, 36, 50, and 66 and then disassembled therefrom for use as utensil rests. In this connection, the utensil rests 10, 24, 34, 48, and 64 can be effectively utilized for supporting utensils on supporting surfaces so that the eating or blade end portions of the utensils are spaced upwardly from the supporting surfaces. Accordingly, the utensil rests 10, 24, 34, 48, and 64 can be effectively utilized for preventing utensils from being contaminated by bacteria and/or other foreign matter on the supporting surfaces, and then can also be effectively utilized for maintaining the supporting surfaces in a substantially neater and cleaner conditions during eating. Accordingly, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A utensil rest comprising a bottom wall portion adapted to be received on a supporting surface and an upstanding peripheral sidewall portion on said bottom wall portion, said sidewall portion terminating in an upper edge and having a pair of spaced upwardly opening peripheral notches therein for receiving and supporting the blade end portion of a table knife so that it is received in both of said notches, said bottom wall portion and said peripheral sidewall portion being dimensioned for supporting the eating end portion of an additional table utensil on said upper edge when said table knife is received in said notches and being further dimensioned such that the handle end portions of said table knife and said additional table utensil are supportable on said supporting surface with said table knife and said additional utensil in substantially parallel relation when the blade end portion of said knife is received in said notches and the eating end portion of said additional utensil is supported on said upper edge.

2. In the utensils rest of claim 1, said peripheral sidewall portion extending substantially continuously around the entire perimeter of said base portion.

3. In combination, a food container and a utensil rest received in assembled relation with said container, said utensil rest comprising a bottom wall portion adapted to be received on a supporting surface and an upstanding peripheral sidewall portion on said bottom wall portion, said sidewall portion terminating in an upper edge and having a pair of spaced, upwardly opening peripheral notches therein for receiving and supporting the blade end portion of a table knife so that it is received in both of said notches, said bottom wall portion and said peripheral sidewall portion being dimensioned for supporting the eating end portion of an additional table utensil on said upper edge when said table knife is received in said notches and being further dimensioned such that the handle end portions of said table knife and said additional table utensil are supportable on said supporting surface with said table knife and said additional utensil in substantially parallel relation when the blade end portion of said knife is received in said notches and the eating end portion of said additional utensil is supported on said upper edge, said container comprising a food container having top and bottom ends, said utensil rest being removably received on one of said top or bottom ends.

4. In the combination of claim 3, said food container having a recessed bottom end, said utensil rest being removably received in said recessed bottom end.

5. In the combination of claim 4, said utensil rest being removably received in an inverted disposition in said recessed bottom end.

6. In the combination of claim 5, said utensil rest peripheral sidewall portion extending substantially continuously around the entire perimeter of said base portion.

7. In the combination of claim 6, said utensil rest further comprising a tab on the upper edge of said peripheral flange portion, said tab extending outwardly from the bottom end of said food container when said utensil rest is assembled therewith.

8. In the combination of claim 4, said food container further characterized as a disposable drinking cup.

9. In the combination of claim 3, said utensil rest being removably received in an inverted disposition on the upper end of said food container.

10. In the combination of claim 9, said utensil rest peripheral sidewall portion extending substantially continuously around the entire perimeter of said base portion.

11. In the combination of claim 10, said food container being open at the upper end thereof, said utensil rest forming a cover on the upper end of said food container.

12. In the combination of claim 11, said sidewall portion including an engagement portion which extends upwardly from said bottom wall portion when said bottom wall portion is received on a supporting surface and a rest portion which extends upwardly from said engagement portion to said upper edge when said bottom wall portion is received on a supporting surface, said engagement portion being engageable with said food container adjacent the upper end thereof for releasably retaining said utensil rest thereon, said slots extending into said rest portion but not into said engagement portion.

* * * * *